United States Patent [19]

Steinegger et al.

[11] 4,106,759

[45] Aug. 15, 1978

[54] DEVICE AND METHOD FOR THE INTRODUCTION OF GASES INTO REACTION VESSELS CONTAINING LIQUIDS

[75] Inventors: Alfred Steinegger, Venthône; Ernst Huber, Schaffhausen, both of Switzerland

[73] Assignee: Swiss Aluminium Ltd., Chippis, Switzerland

[21] Appl. No.: 802,527

[22] Filed: Jun. 1, 1977

[30] Foreign Application Priority Data

Jun. 1, 1976 [CH] Switzerland ..... 6835/76

[51] Int. Cl.[2] ..... C21C 5/48

[52] U.S. Cl. ..... 266/220

[58] Field of Search ..... 266/220–224, 266/265–270

[56] References Cited

U.S. PATENT DOCUMENTS

| | | | |
|---|---|---|---|
| 3,330,645 | 7/1967 | DeMoustier et al. | 266/220 |
| 3,636,872 | 1/1972 | Forcier | 266/265 |
| 3,917,242 | 11/1975 | Bass et al. | 266/207 |
| 3,971,548 | 7/1976 | Folgero et al. | 266/265 |
| 4,053,147 | 10/1977 | Moser et al. | 266/220 |

FOREIGN PATENT DOCUMENTS

| | | | |
|---|---|---|---|
| 2,105,961 | 8/1972 | Fed. Rep. of Germany | 266/220 |

*Primary Examiner*—Gerald A. Dost

*Attorney, Agent, or Firm*—Ernest F. Marmorek

[57] ABSTRACT

The invention relates to a device for introduction of gases into reaction vessels containing liquids, especially vessels undergoing thermal stress, in particular filter housings for metal melts, using a gas-permeable body of heat-resistant material, fitting into a metal sleeve anchored in the wall of the reaction vessel. The wall of the reaction vessel consists of three different layers, namely a rigid inner layer of heat-resistant material, a loose intermediate layer of bulk material, and a casing of metal. The metal sleeve extends from the outside into the loose intermediate layer, the rigid inner layer and the gas-permeable inlet body are directly adjacent to one another, and the boundary surface of the gas-permeable inlet body has a permanently applied, thoroughly gas-tight cover of ceramic material.

19 Claims, 7 Drawing Figures

DEVICE AND METHOD FOR THE INTRODUCTION OF GASES INTO REACTION VESSELS CONTAINING LIQUIDS

CROSS-REFERENCES TO OTHER APPLICATIONS

Reference is had to the co-pending application, Ser. No. 649,137, filed on Jan. 14, 1976 of Robert Moser, Alfred Steinegger, Fritz Dolder and Horst Feddern, entitled "Device for Introduction of Gases Into Reaction Vessels Containing Fluids" assigned to the assignee of the instant application.

BACKGROUND OF THE INVENTION

The invention relates to a device for introduction of gases into reaction vessels containing liquids, especially vessels undergoing thermal stress, in particular filter housings for metal melts, by means of a gas-permeable body of heat-resistant material, fitting into a metal sleeve, which itself is anchored in the wall of the reaction vessel.

Since the introduction of methods for treatment of metal melts, in which gases are continuously injected into the melt, it has been found difficult to secure the gas-permeable inlet bodies of heat-resistant material in the wall of the reaction vessel in an easily exchangeable but nevertheless leak-tight-manner. In view of the state of the art, an attempt have therefore focussed to build in the inlet body permanently into the wall of the vessel, the latter consisting of concrete or similar materials. However, this solution leads to the significant disadvantage that, upon the periodical exchange of inlet bodies, the relevant wall of the reaction vessel has to be totally destroyed, which in turn is unduly costly causes a significant loss of time, and reduces the operating working time of the relevant reaction vessel in a significant way.

Therefore, a further attempt has been made to facilitate the exchange of the inlet body, by surrounding the inlet body with a metal sleeve, and by anchoring the latter in the wall of the reaction vessel.

The objective aimed at was, however, not satisfactorily achieved in this way, since undesired side effects arose causing severe disadvantages compared to the conventional installation of the inlet body, namely tightness of the device with a view to prevent any leaks could not be significantly improved by the use of the metal sleeve, and any undesired loss of gas could not be effectively eliminated; compared to a brick built-in directly into the wall, a device consisting of an inlet body, a metal sleeve and a wall has significantly greater differences in the coefficient of thermal expansion of the various materials present in the system. If the inlet body, substantially in accordance with the proposals of U.S. Pat. No. 2,811,346 of U.S. Pat. No. 2,947,527, is, however, rigidly anchored by means of screws to the metal sleeve, then the metal sleeve expands significantly more than the inlet body upon heating up of the device by the metal melt. Therefore, a gap arises between sleeve and inlet body, through which the gas escapes, or into which the liquids from the reaction vessel can pass, if no excess gas pressure prevails in the gas inlet body.

The use of a metal sleeve between the inlet body and the wall of the reaction vessel leads to the further disadvantage that the metal sleeve ifself, by the combination of thermal and chemical effects, is prematurely damaged, and that the liquid in the reaction vessel is polluted by metal material of the sleeve. This is especially undesired, if the device is used to treat highly purified metal melts. The direct contact between the metal of the sleeve and the contents of the filter housing, and the corrosion thereby arising severely constrains a more widespread use of the device at an prevents it from being applied to the injection of gas into chemically corrosive liquids, as for example strong acids, an elevated temperature.

Neither has a satisfactory solution of the problem of easy exchangeability been achieved yet in the present state-of-the art, although devices have been designed, in which the metal sleeve is fastened by means of screws to the outer wall of the reaction vessel (U.S. Patent Specification 2,871,008, FIG. 5). But the designer of that device has not taken into account the fact that the metal sleeve, being an excellent thermal conductor, is in direct contact with the hot liquid in the interior of the filter housing, and that during the operation of the installation a steep temperature gradient may therefore occur along the longitudinal axis of the sleeve. The thermal expansion of the sleeve in its longitudinal direction exceeds that of the material of the wall of the reaction vessel surrounding it, or of that of the inlet body. This in turn, leads to a dislocation of the sleeve with respect to its surroundings, and if, it is firmly anchored both in the wall and in the steel casing of the reaction vessel, as indicated in U.S. Pat. No. 2,871,008 FIG. 5, this might lead to mechanical tensions, if not cracks. An improvement in devices for the introduction of gases into reaction vessels containing fluids is also disclosed in copending application Ser. No. 649,137; additional pertinent references are U.S. Pat. No. 3,343,829, disclosing a porous plug assembly for a metallurgical receptacle, U.S. Pat. No. 3,834,685, teaching an apparatus for injecting fluids into molten metals, and British Pat. Specification No. 697,915, relating to improvements in Ladles for Gas Flushing Molten Metal. The advantageous combination of a substantially air-tight shell of ceramic material secured to the side surface of an inlet body and a loose intermediate layer of bulk material included in the wall of the reaction vessel has not been found in the prior art.

SUMMARY OF THE INVENTION

It is an object of the present invention to design a device for introduction of gases into reaction vessels obviating the indicated drawbacks of the state of the art. This relates to, for example, avoidance of poor exchangeability of the built-in device; limitation of direct contact between the metal sleeve and the contents of the reaction vessel, and, possibly, a minimization of thermal effects in the metal sleeve and between the metal sleeve and the surroundings with a view towards improving the tightness of the device with respect to leaks.

This aim is achieved by using a wall of the reaction vessel including three layers namely, a rigid inner layer of heat-resistant material, a loose intermediate layer of bulk material and a casing of metal, that the metal sleeve extends from the exterior inwards into this loose intermediate layer, that the rigid inner layer and the gas-permeable inlet body are directly adjacent to one another, and that the boundary surface of the gas-permeable inlet body has a permanently applied, thoroughly gas-tight cover of ceramic material. This arrangement is an improvement over the structure disclosed in Application Ser. No. 649,137, which does not include the loose intermediate layer of bulk material of the present application, nor the gas-tight cover of ceramic material surrounding the boundary surface of the gas-permeable inlet body.

The construction of the wall of the reaction vessel of three layers allows the anchoring of the inlet body to the rigid inner layer in a leak; tight manner, the absorption of possible relatively small thermo-mechanical effects of the metal sleeve in the loose bulk layer, and fastening of the entire device to the metal outer wall of the reaction vessel in a simple an easily exchangeable way. The fact that the metal sleeve is designed about half as short as indicated by the state of the prior art prevents the sleeve from being in direct contact with any chemically active contents of the reaction vessel, thereby reducing corrosion damage, and any thermal expansion of the sleeve significantly. The fact that, in the area of the rigid inner wall of the reaction vessel which is exposed to significant thermal stresses only, ceramic materials having comparable thermal coefficients of expansion abut one another, but that no metal parts are present, reduces any leaks due to the state of the art, between the inner wall of the reaction vessel and the inlet body to a significant extent.

Finally, the thoroughly gas-tight coating of the boundary surface of the inlet body made of heat-proof material ensures that only traces of gas can emerge at any undesired places from the inlet body.

BRIEF DESCRIPTION OF THE DRAWING

Different examples of designs for the introduction of gas based on the present invention are shown in the drawings and will be described in more detail below. In particular.

DESCRIPTION OF THE PREFERRED EMBODIMENTS

Figure 1:
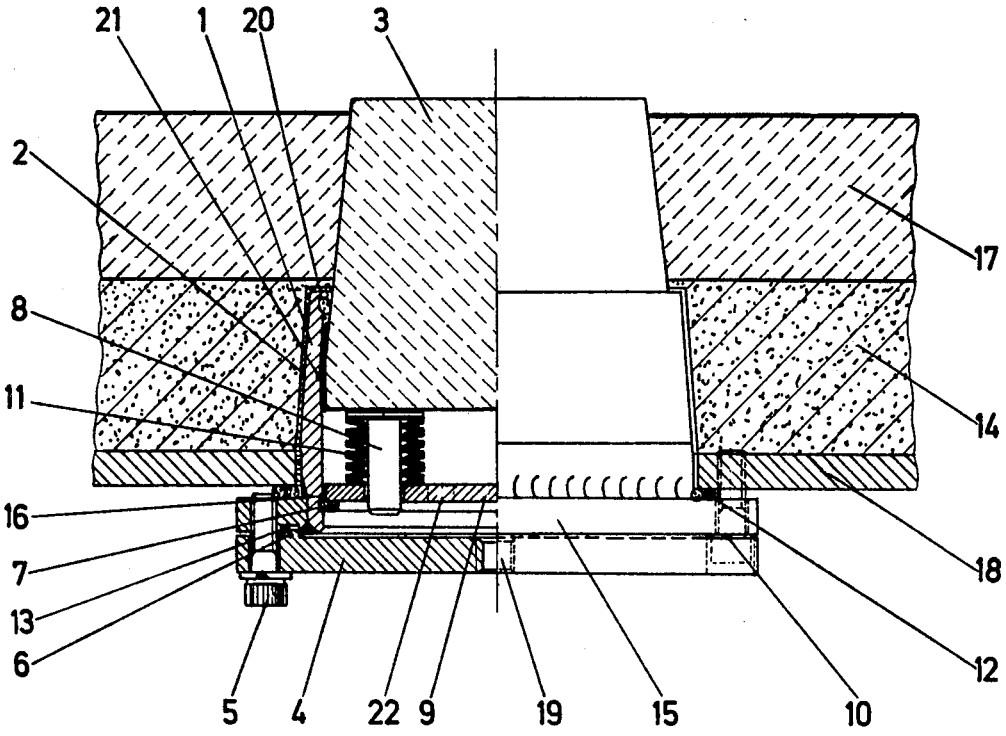
FIGS. 1 to 5 show various gas inlet devices in longitudinal section, the inlet body of which is formed as a frustum of a cone, differing from one another in the kind of fastening of the inlet body to the metal sleeve.

In essence, the inlet device consists a metal sleeve 1, an inlet body 3 of porous heat-resistant material and a metal cover 4 on a side facing an outer wall 18 of the reaction vessel. The gas to be injected enters through a bore 19 in the cover 4, passes into a manifold, reaches the inlet body 3, and leaves this inlet body 3 at the surface of an end facing the inner wall of the reaction vessel in the form of fine bubbles. The wall (14, 17, 18) of the reaction vessel, in which the device is anchored, is formed by three layers of different materials: a rigid inner layer 17 of heat-resistant concrete, an intermediate layer 14 of more or less loose, finely stamped material, and an outer metal wall 18 covering the entire reaction vessel. The metal sleeve 1 of the inlet device extends from the outside up to the loose intermediate layer 14. Since it does not pass through the entire wall of the reaction vessel and therefore does not make contact with the liquid contained in the reaction vessel, one avoids on the one hand, that the sleeve 1 being a good thermal conductor, is heated to any undesired extent, and, on the other hand, that it is corroded by the chemically reactive liquids in the container. Any slight thermal expansion of the sleeve 1, which occurs, nevertheless, may be largely compensated for by the loose intermediate layer 14.

Due to the fact that the inlet body 3 immediately borders the thermally inner side or layer 17, and because materials of similar thermal coefficients of expansion abut one another, leakages of any significance as a consequence of different thermal rates of expansion of the materials can be avoided. If however, any slight leakage should occur between the wall 17 and the inlet body 3, a thoroughly gas-tight coating 33 for the boundary surface of the inlet body 3, of ceramic material, ensures that the gas mainly penetrates from the end surface of the inlet body 3, in the form of fine bubbles, and only in insignificant amounts between the inlet body 3 and the wall (14, 17) of the reaction vessel.

Figure 2:
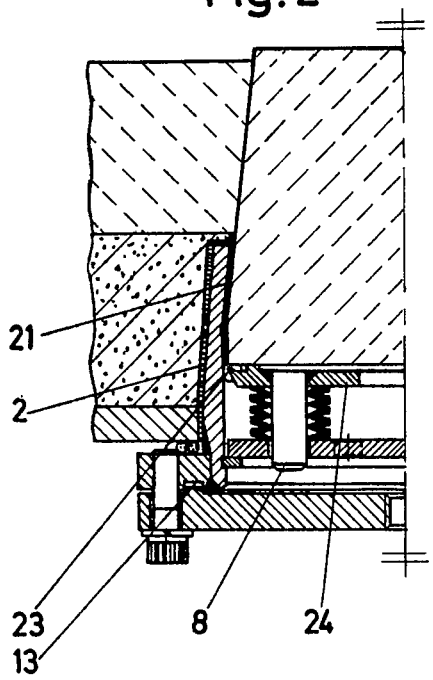

The device may be fastened to the wall of the reaction vessel in the following way:, as shown in FIGS. 1 and 2: (FIG. 1 and 2) the outer edge of the metal sleeve 1 is welded to an annular metal disc 15, which has a plurality of holes for receiving screws 5. This metal disc 15 is secured by the screws 5 to the metal outer wall 18 of the reaction vessel. If especially large thermal effects are to be expected on heating of the reaction vessel, the screws 5 can additionally be seated on non-illustrated convex springs 10. Asbestos cords 12 can be incorporated between the metal disc 15 and the outer casing 17. The metal sleeve 1 fits into corresponding openings of the wall of the reaction vessel and extends into the loose intermediate layer 14. It may be formed as a frusto-conical hollow shaped portion with a hollow cylindrical portion secured thereto (as shown in FIGS. 1 to 5), but it may also be formed as a hollow cylinder, as shown in (FIG. 6).

Between the metal sleeve 1 and the loose intermediate layer 14, a layer of heat-resistant insulating material 2 may be used for sealing and heat insulation. Between the metal sleeve 1 and the inlet body 3, the seal is effected by a sealing ring 20 of elastic material fitting into a corresponding recess of the sleeve, combined with a further layer 21 of insulating material.

The inlet body 3 consists of porous, heat-resistant material, for example zirconium silicate. The conical or cylindrical boundary is, surrounded by a compact, thoroughly gas-tight layer 33 of ceramic material, and conforms in its shape to the sleeve 1, and to the opening in the inner layer 17 of the wall of the reaction vessel. The inlet body 3 is mounted in the following way: (FIG. 1 and 2) It is first loosely placed in the sleeve 1 and thereupon, the seals 20 and 21 are applied between the sleeve 1 and the inlet body 3. A predetermined number of columns of spring discs is arranged subsequently, between the inlet body 3 and the sleeve 1, each column consisting of individual spring discs 11 arranged in series alternately on a central pin 8, which pins 8 are inserted in the openings provided for them in an intermediate metal plate or dish 9. The latter is thereafter moved under pressure to the level of an annular groove 16, formed in the metal sleeve 1 and locked at this level by a circlip lock ring 7 fitting into the annular groove 16. The devices according to FIGS. 1 and 2, having identical functions, differ from one another in that, according to FIG. 1 the individual central pins 8 of the columns of spring discs 11 are provided with a circular metal plate at their end facing the inlet body and abut directly against the inlet body 3, while, according to FIG. 2 the individual central pins 8 are secured at their respective ends facing the inlet body 3 to a metal ring 24, which abuts against the inlet body 3. A seal of elastic material 23 closes the gap between annular ring 24, the inlet body 3, and the sleeve 1. The sequence of the steps in the assembly of the sleeve 1, and the inlet body 3 into the wall of the reaction vessel is arbitrary. It does not make any difference whether the sleeve 1 is first fastened to the wall and the inlet body 3 thereafter installed, or whether the inlet body 3 is first mounted in the sleeve 1, and the entire device thereafter fastened to the wall. Due to the circlip lock ring 7 the porous inlet body 3 may be exchanged at any time while leaving the metal sleeve 1 in the wall of the reaction vessel.

The entire device, according to FIGS. 1 and 2, is closed at the outside by a circular metal cover 4 which has a central bore 19 for introduction of a gas inlet pipe, and has a thickened rim 6 which fits in a corresponding recess of the metal disc 15, if necessary by means of a corresponding annular-shaped seal 13 of a suitable material.

The gas penetrates through the central bore 19 into a manifold constituted by the cover 4 and the metal sleeve 1, and passes thereupon through several further bores 22 in the intermediate plate 9 into a further manifold containing the springs 11. From there it is finally injected into the gas-permeable inlet body 3. In the pores of the latter, the gas is finely divided, and passes through an end side of the inlet body 3 facing away from the cover 4 into the reaction vessel in the form of fine bubbles. Alternate designs include the use of a hollow cylinder or sleeve 27 permanently connected to the cover 4, which replaces the springs 11 of FIGS. 1 and 2. The hollow cylinder 27 fits into the cylindrical part of the sleeve 1 (FIGS. 3 to 5) and is supplemented by various kinds of seals, which ensure a gas-tight closure between the inlet body 3, the sleeve 1 and the hollow cylinder 27.

Figure 3:
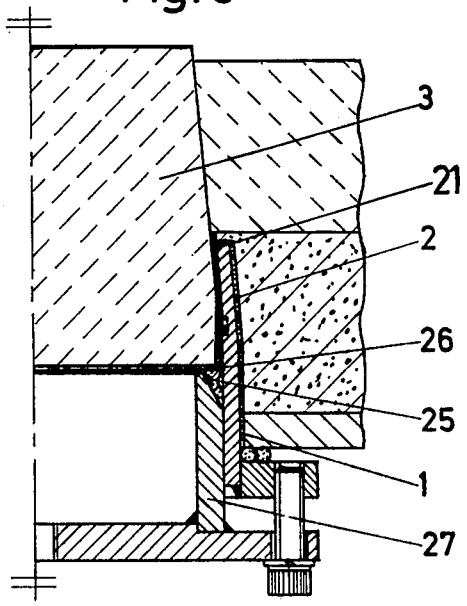

In the device according to FIG. 3, the hollow cylinder 27 has a bevelled upper edge, onto which fits a sealing ring 25. The cross section of the latter is chosen to provide a double sealing effect, and to prevent any escape of gas between the hollow cylinder 27 and the inlet body 3 on one hand and between the hollow cylinder 27 and the sleeve 1 on the other hand. In addition, an auxiliary sealing ring 26 can be provided between the sealing ring 25 and the end side of the inlet body 3.

Figure 4:
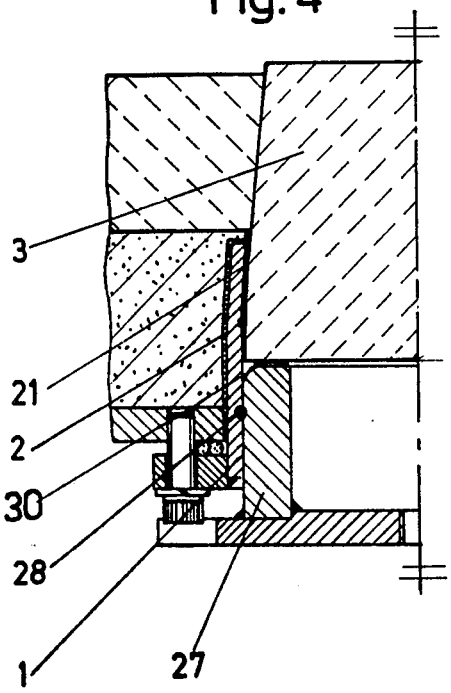

In the device according to FIG. 4 the wall thickness of the hollow cylinder 27 has been selected to be relatively large, and an annulus 30 of a suitable material has been added between the hollow cylinder 27 and the inlet body 3. In this arrangement the seal between the sleeve 1 and inlet body 3 can be further improved or supplemented by an insulating layer 21. An additional seal 28 of elastic material can be inserted in corresponding recesses of the sleeve 1 and the hollow cylinder 27.

Figure 5:
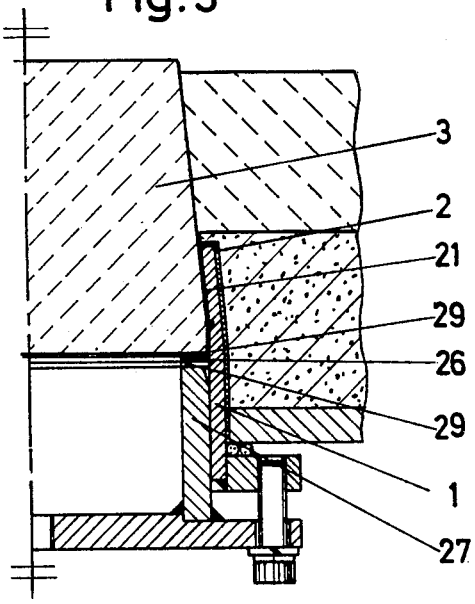
Figure 6:
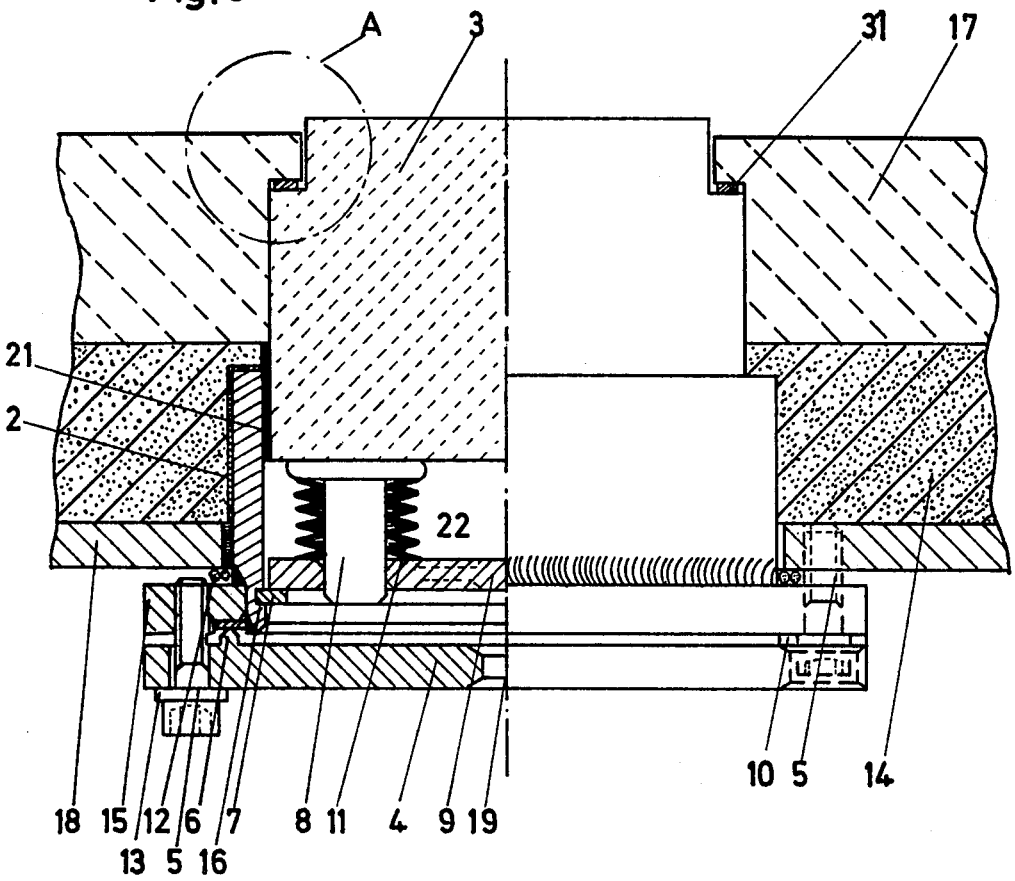
FIG. 6 shows a gas inlet device in longitudinal section, the inlet body of which is formed as a cylinder.

This sealing arrangement is simplified in the design according to FIG. 5, further by the addition between the upper edge of the hollow cylinder 27 and the inlet body 3 of two separate annular seals of insulating material 29, and the addition of a third circular ring 26 therebetween. The seal between the sleeve 1 and the inlet body 3 is, in turn supplemented in this arrangement also by an insulating layer 21. The designs, according to FIGS. 3 to 5, show the advantage over the prior art, by the pressure for fixing the inlet body 3 being not exerted in the center but at the periphery of the inlet body 3, which ensures a better seal.

Figure 7:
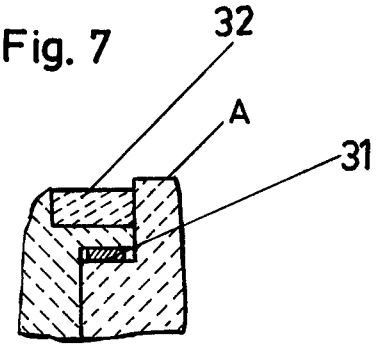
FIG. 7 a modified detail A of the gas inlet device, according to FIG. 6.

An alternate design makes use of a cylindrical inlet body 3 (FIGS. 6 and 7), which, at its side facing the interior of the reaction vessel, has a further cylindrical portion of a relatively small diameter. The inlet body 3 fits within the projecting rim of the inner layer 17, which can also be reinforced by a ring of finely ground concrete 32. At the transition point between the two cylindrical portions of the inlet body, a seal 31, can be introduced, which prevents an escape of gas between the inner wall 17 and inlet body 3. Using an inlet body 3, whose boundary surface is sealed permanently with a suitable material, further reduces any loss of gas which loss is economically significant, if argon or any other noble gas is used.

Satisfactory results were obtained by sealing inlet bodies of zirconium silicate with asbestos fiber cement of different qualities, or with aluminum silicate fiber cement. A layer of material less than 1 mm thick was applied to the boundary surface of the inlet body by a suitable technique (trowelling, painting, spraying), and thereafter either dried during 1 to 2 hours at 120° C to 200° C, or subsequently sintered for 2 or more hours at a temperature identical with the respective temperature of operation, i.e. between 600° C and 1000° C. At an experimental pressure of 300 mm $H_2O$ and using inlet bodies having a ratio between the area of the end surface, and the area of boundary surface of about 1 : 3, the inlet bodies sealed according to this method, have increased the ratio X between the gas flow emerging at the end surface, and the gas flow emerging through the boundary surface per unit of time (e.g $\lambda_o = 0.3$ for an untreated body) by a factor which may exceed a value of $\lambda_1 : \lambda_0 = 10$ (c.f. Table 1, being the above-cited ratio for a treated inlet body, upon suitable choice of material and of the application technique.

In an operational example argon was injected into an aluminium melt using a device according to FIG. 1. The gas pressure in the manifold in front of the inlet body amounted to 1 to 3 atmospheres, the flow rate was 3.3 $Nm^3/h.\ m^2$ (surface of melt) in continuous operation, and the temperature of the aluminium melt was 710° C. The inlet body was made of zirconium silicate, the sleeve of steel, and the wall of the reaction vessel consisted of a layer of heat-resisting cement, a loose intermediate layer of calcium silicate fibers with a binder, and a steel casing. In comparison with the inlet device having a built-in inlet body, the losses of gas could be reduced by 50% in continuous operation, while maintaining an identical quality of the purified metal. Once assembled the devices proved to be practically maintenance-free, while frequently occurring leaks had to be repaired with built-in inlet bodies. Whereas built-in bricks had to be exchanged after about 3 months of continuous operation, the inlet bodies designed according to the present invention proved to be in a perfect operational state following more than six months of operation.

TABLE I

| Sealing material | Gas flow through end face Stone untreated (liters/minute) End face | Boundary | Ratio $\lambda_0$ | Flow through end face Stone treated (liters/minute) End face | Boundary | Ratio $\lambda_1$ | Sealing effect $\lambda_1/\lambda_0$ |
|---|---|---|---|---|---|---|---|
| Asbestos cement | | | | | | | |
| trowelled | 2.2 | 7.0 | 0.314 | 4.0 | 1.0 | 4.0 | 12.74 |
| sprayed | 2.1 | 6.5 | 0.323 | 3.8 | 1.0 | 3.8 | 11.76 |
| painted | 2.2 | 7.0 | 0.314 | 4.2 | <1.0 | >4.2 | >13 |

TABLE I-continued

| Sealing material | Gas flow through end face Stone untreated (liters/minute) End face | Boundary | Ratio $\lambda_0$ | Flow through end face Stone treated (liters/minute) End face | Boundary | Ratio $\lambda_1$ | Sealing effect $\lambda_1/\lambda_0$ |
|---|---|---|---|---|---|---|---|
| Aluminum silicate cement | | | | | | | |
| trowelled | 2.3 | 7.0 | 0.329 | 1.9 | 1.3 | 1.462 | 4.44 |
| sprayed | 2.8 | 5.2 | 0.538 | 2.6 | <1.0 | >2.6 | >4.8 |
| painted | 2.0 | 6.5 | 0.308 | 4.1 | <1.0 | >4.1 | >13 |

Effect of sealing of gas inlet bodies on the loss of gas injected through the cone (cylinder) boundary.
Experimental gas pressure used : 300 mm $H_2O$
Area ratio end, to boundary, approx 1 : 3
Material of gas inlet body: zirconium silicate
Drying: 12 hours at 120° C,
Sintering: at least 1 hour at 800° C

We claim:

1. A device for the introduction of gas, in combination comprising:

a walled reaction vessel adapted to contain liquids, such as metal melts, the vessel being exposed to thermal stresses, a sleeve secured to the wall of the reaction vessel, a gas-permeable inlet body of heat-resistant material fitting into said sleeve, the wall of the reaction vessel including a rigid inner layer of heat-resistant material, a loose intermediate layer of bulk material, and a casing, said sleeve extending from the exterior of said vessel into said casing, said rigid inner layer and said gas-permeable inlet body being disposed directly adjacent to one another, and a substantially air-tight shell of ceramic material secured to a side surface of said inlet body.

2. An apparatus according to claim 1, wherein the cross-section of said gas-permeable inlet body is substantially circular.

3. An apparatus according to claim 1, wherein the gas-permeable inlet body has a frustro-conical portion and a cylindrical portion, joined to the frustro-conical portion at the larger cross-section of the frustro-conical portion.

4. A device according to claim 1, wherein the gas-permeable inlet body includes two cylindrical portions of different respective cross-sections.

5. A device according to claim 4, further comprising sealing means disposed between the sleeve and said gas-permeable inlet body.

6. A device according to claim 5, wherein said sealing means comprises a ring disposed in the vicinity of transition of the cylindrical portions.

7. A device according to claim 1, further comprising yieldably resilient means for detachably connecting said gas-permeable inlet body to said sleeve.

8. A device according to claim 7, wherein said yieldably resilient means includes a column of alternately arranged spring discs and a plurality of central pins supporting each of the columns of spring discs, respectively.

9. A device according to claim 8, wherein said sleeve has an annular groove, and wherein each of said columns of spring discs includes a dish having a plurality of openings, a corresponding one of the columns of spring discs being secured to a corresponding one of the dishes, and a locking ring insertable into said groove for locking said dishes to said sleeve.

10. A device according to claim 8, wherein each of said pins includes an annular washer connected thereto at an end of said pin facing said gas-permeable body, and further comprising an annular seal of elastic material disposed around said washer for sealing said sleeve, said gas-permeable body and said annular washer.

11. A device according to claim 1, further comprising an annular ring connected to said sleeve at an end of said sleeve facing said casing, and securing means for connecting said annular ring to said casing.

12. A device according to claim 1, further comprising a plate releasably connected to said sleeve at an end thereof facing said casing, said plate having at least one bore for introducing the gas into said gas-permeable inlet body.

13. A device according to claim 12, further comprising a hollow cylinder permanently connected to said plate.

14. A device according to claim 12, further comprising a sealing ring for sealing said sleeve, said gas-permeable inlet body and said hollow cylinder.

15. A device according to claim 14, further comprising a second sealing ring disposed between the first sealing ring and an end of said inlet body facing the sleeve.

16. A device according to claim 13, further comprising a third sealing ring for sealing said gas-permeable inlet body and said hollow cylinder, a fourth sealing ring for sealing said sleeve and said hollow cylinder, and a layer of insulating material for sealing said sleeve to said gas-permeable inlet body.

17. A device according to claim 13, further comprising an annulus and two annular layers of insulating material for sealing said inlet body and said hollow cylinder, said sleeve and said gas-permeable inlet body, respectively.

18. A device according to claim 1, wherein said inner layer includes a ring of finely ground concrete for the reinforcing of said inner layer.

19. A device according to claim 1, wherein said sleeve and said casing are composed of metal.

* * * * *